United States Patent [19]

Moser

[11] 4,153,977

[45] May 15, 1979

[54] METHOD OF FORMING A CONTINUOUS FIBER LAYER OF CONSTANT WEIGHT PER UNIT LENGTH AND APPARATUS FOR IMPLEMENTING THE METHOD

[75] Inventor: Robert Moser, Winterthur, Switzerland

[73] Assignee: Rieter Machine Works Ltd., Switzerland, Winterthur, Switzerland

[21] Appl. No.: 880,648

[22] Filed: Feb. 23, 1978

[30] Foreign Application Priority Data

Mar. 18, 1977 [CA] Canada ..... 3396/77

[51] Int. Cl.[2] ..... D01H 5/32

[52] U.S. Cl. ..... 19/240; 19/308

[58] Field of Search ..... 19/240, 239, 305, 306, 19/307, 308, 88, 89

[56] References Cited

U.S. PATENT DOCUMENTS

| | | | |
|---|---|---|---|
| 3,239,889 | 3/1966 | Caughlin | 19/240 X |
| 3,256,569 | 6/1966 | Draving | 19/240 X |

*Primary Examiner*—Dorsey Newton

*Attorney, Agent, or Firm*—Werner W. Kleeman

[57] ABSTRACT

A method of, and apparatus for, forming a fiber layer of substantially constant weight per unit length, there being provided supply means for supplying a fiber and air mixture onto a moving, fiber-separating, perforated surface. A suction opening is arranged beneath and extends over a certain zone or region of such perforated surface. The suction opening can be moved forward and backward with respect to the direction of transport of the fiber and air mixture by the perforated surface as a function of a measuring value which is representative of the thickness of the fiber layer deposited upon such perforated surface.

18 Claims, 3 Drawing Figures

METHOD OF FORMING A CONTINUOUS FIBER LAYER OF CONSTANT WEIGHT PER UNIT LENGTH AND APPARATUS FOR IMPLEMENTING THE METHOD

BACKGROUND OF THE INVENTION

The present invention relates to a new and improved method of, and apparatus for, forming a continuous fiber layer of substantially constant weight per unit length.

Generally speaking, the arrangement useful for practicing the teachings of the invention embodies supply means for supplying a fiber and air mixture onto a moving, fiber-separating, perforated surface, with a suction opening arranged beneath and extending over a certain zone or region of such perforated surface.

In Austrian patent application No. A4103/66 it is proposed to prevent an uneven fiber deposition upon a perforated or sieve drum, internally of which there prevail vacuum conditions, by providing a drum-shaped cover-shield having a slot and arranged within the perforated drum. This slotted cover-shield oscillates back and forth beneath the contact or impact zone of the fibers which are supplied onto the surface of the perforated drum. As a result, the fibers are deflected throughout a wide zone of the surface of the perforated drum and are distributed during deposition. Hence, there is realized an evening action in the event of deviations in the fiber supply lasting for a short period of time. The weight and the uniformity of the fiber layer which is formed, with this prior art equipment depends exclusively upon the evenness or regularity of the fiber supply. Variations of the fiber supply which last over longer time intervals cannot be evened-out or compensated.

In U.S. Pat. No. 3,239,890 there is taught to the art equipment for forming a fiber layer of constant thickness. Fibers are supplied by means of an air stream onto a rotating perforated or sieve drum within which there prevails a vacuum. The fiber layer forming on the perforated drum produces a pressure drop between the exterior and interior of the perforated drum, this pressure drop corresponding to the thickness of the deposited fiber layer. These pressure variations are measured and utilized for controlling the rotational speed of the perforated drum as a function of the thickness of the fiber layer. Devices of this type, however, are only suitable if, on the one hand, there are not made any great demands upon the short term evenness or regularity of the fiber layer, and, on the other hand, if the fiber layer is not transferred to a machine reguiring a constant supply speed.

Irregularities in the supply or infeed of the fiber material and in the material removal can be only leveled out or compensated by the aforementioned equipment to a limited degree. Equally, it is not possible to achieve uniform deposition of the fiber material upon the perforated drum. Fiber deposition is more or less random.

SUMMARY OF THE INVENTION

Therefore, with the foregoing in mind it is a primary object of the present invention to overcome the previously explained drawbacks and limitations of the prior art proposals.

Another and more specific object of the present invention aims at devising an improved method of, and apparatus for, forming a continuous fiber layer of essentially constant weight per unit length, in an extremely reliable, efficient and positive manner.

Still a futher significant and more specific object of the present invention relates to a new and improved method of, and apparatus for, forming a continuous fiber layer of substantially constant weight per unit length, by means of which there can be set the reference value of the density or the weight per unit length, respectively, of the fiber layer to be produced and the same can be maintained essentially constant both over short and long intervals.

Yet a further significant object of the present invention aims at providing apparatus for forming a continuous fiber layer of substantially constant weight per unit length which is structured such as to provide a storage capacity for the fiber material, can level-out or compensate variations or interruptions occurring at the supply side and/or at the delivery side, without affecting the operation of, or requiring interruption of, preceding arranged machines or subsequently arranged machines.

Now in order to implement these and still further objects of the invention, which will become more readily apparent as the description proceeds, the method aspects of the present development are generally manifested by the features that as a function of a measuring or measurement value representative of the thickness of the fiber layer the suction opening is moved forward and backward with respect to the direction of transport of the fiber material by the perforated surface.

As already mentioned heretofore, the invention is not only concerned with the aforementioned method aspects, but also relates to apparatus for the performance thereof, which apparatus embodies a drive operatively connected with the rotatable suction opening, i.e. the means forming such rotatable suction opening. This drive rotates or otherwise moves the suction opening forward or backward, the drive being controlled by a control or regulating device as a function of the measuring value.

BRIEF DESCRIPTION OF THE DRAWING

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
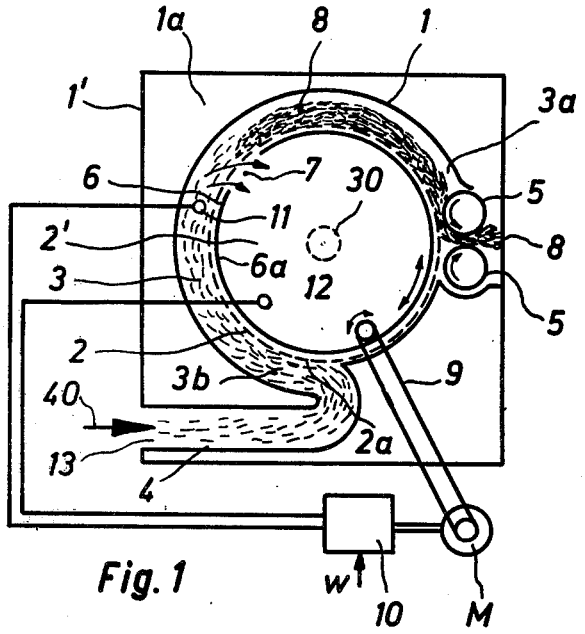
FIG. 1 schematically shows in cross-sectional view an exemplary embodiment of apparatus for forming a continuous fiber layer of essentially constant weight per unit length and useful for the practice of the method teachings of the invention, there being specifically shown a perforated or sieve drum having a rotatable cover shield and housing as well as drive means for the cover shield.

Describing now the drawings, it is to be understood that only enough of the structure of the apparatus has been shown to simplify the illustration, as will enable those skilled in the art to readily understand the underlying principles and concepts of the invention. The exemplary embodiment of apparatus shown in FIG. 1 will be seen to comprise a suitable housing 1' containing internally thereof a substantially cylindrical hollow space or compartment, generally indicated by reference character 1a, within which there is axially and rotatably mounted in any suitable fashion a substantially cylindrical perforated or sieve drum 2 constituting a moving, fiber-separating, perforated or sieve surface. Any suitable drive means, such as a drive motor, can be used for appropriately rotating the cylindrical perforated or sieve drum 2, such drum drive means not being specifically shown as such structure is conventional and unimportant for understanding the invention. The interior of the housing 1' is provided with a recess 1 or equivalent structure which in conjunction with the perforated drum 2 forms an annular duct or channel 3 closed at its end face of face side by any suitable means (not shown), such as a cover plate or member. This annular duct or channel 3 is tangentially connected via a further duct or channel 4 with any appropriate machine for supplying a mixture of fibers and air. The end 3a of the annular or ring-shaped duct 3 which is removed from the end 3b merging with the infeed duct or channel 4 is closed by a pair of take-off rolls 5 or other suitable fiber removal means.

Figure 2:
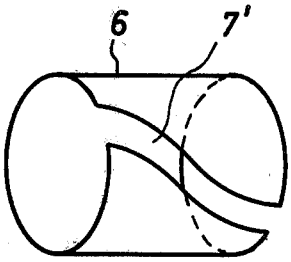
FIG. 2 is a schematic showing of a modified form of cover shield provided with a helical-like slot.

The internal space or area 2' of the perforated drum is operatively connected with a vacuum source, generally schematically indicated by reference character 30, in a manner such that a vacuum prevails within the perforated drum 2.

a substantially cylindrical cover shield or screen means 6 is arranged coaxially and rotatably within the perforated drum 2. The diameter of this cover shield 6 is somewhat smaller than the inner diameter of the perforated drum 2. Cover shied 6 is provided at its surface 6a with a suction opening in the form of a slot 7. This suction slot 7 may extend essentially parallel to the axis of rotation of the cover shield 6, over the entire length of such cover shield, but it is to be understood that the slot 7 also can be arranged in a non-axial orientation and can be, for instance, of spiral or helical shape. More specifically, in FIG. 2 there is shown the cover shield 6 provided with a slot 7' of essentially helical shape, whereas FIG. 3 shows a slot 7'' which is tapered in a manner as to be explained more fully hereinafter.

Figure 3:
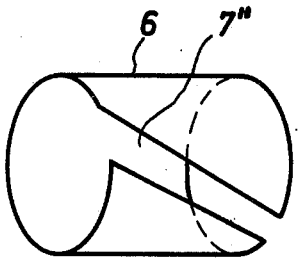
FIG. 3 illustrates a further modified construction of cover shield having a tapered slot.

Now in order to avoid a pressure drop along the slot 7 if a vacuum is generated by the action of the vacuum source 30 due to application of a suction action at an end face or face side of the perforated drum 2, the slot 7 may be tapered, as shown for the slot 7'' of FIG. 3 i.e., is structured to be smaller towards the vacuum source 30 in such a manner that the same quantity of suction air flows through each unit length of such slot 7 and no pressure drop occurs along such slot. The fiber layer 8 therefore is of essentially uniform thickness also across the perforated drum 2 i.e., in the transverse direction thereof.

If the slot 7 is arranged, as explained above, to extend non-axially with respect to the axis of rotation of the cover shield or screen means 6, for instance extends in a spiral or helical configuration (see FIG. 2), then it is possible for the fibers, instead of being layered onto the surface 2a of the drum at right-angles to the fiber layer formed on the perforated drum 2, for such fibers to be diagonally layered or deposited. Consequently, there can be appreciably reduced the danger of disruption of the fiber layer 8 during further processing. Furthermore, with these measures there can be obtained an effect of blending of fibers at a bias to the fiber layer.

Continuing, reference character M denotes a suitable drive or drive means for the cover shield 6. This drive means M may be an electrical motor, a hydraulic drive or motor, which through the agency of a suitable power transmission device 9, for instance a chain, belt, gearing or the like, can selectively move the cover shield 6 forward or backward, as desired. Of course, the drive M also can be arranged within the cover shield 6. A control or regulating device 10 compares measuring or measurement values sensed by two pressure feelers or sensors 11 and 12, such as pressure gauges, arranged within the duct 3 and the interior space or inside area 2' of the perforated drum 2, respectively, with a pre-set value w, and controls the drive means M of the cover shield 6 in such a manner that the pressure difference between the measuring points defined by the measuring or pressure sensors 11 and 12 remains essentially constant. This pressure difference corresponds to a predetermined weight per unit length of the fiber layer, under the precondition that the quantity of suction air is constant. Naturally, the thickness of the fiber layer 8 also can be measured by other conventional means and transduced to the control device or control means 10.

Having now had the benefit of the foregoing discussion of an exemplary embodiment of apparatus, useful for the performance of the method aspects, the mode of operation will be now considered and is as follows:

A suitable fiber supplying machine, merely schematically indicated by the arrow 40 and not here described in greater detail, since any machine appropriate for supplying fibers can be generally employed, infeeds a mixture of fibers and air into the supply duct or channel 4. Owing to the vacuum prevailing in the interior or inside area 2' of the perforated drum 2 the thus infed fibers are deposited onto the surface 2a of the perforated drum 2 and, at the same time, are separated from the air in the zone or region of the duct 3 below which there is located the slot 7 of the cover shield or screening means 6. Now if this air-permeable zone is evenly covered with a fiber layer 8, which is effected throughout the entire zone of the slot 7 due to the uniform vacuum or suction action, then the pressure drop or gradient between the inside area or space 2' of the perforated drum 2 and the duct 3 remains constant and the cover shield or screening means 6 does not change its position when such pressure drop corresponds to a pre-set desired value, such as the set value w. However, if for instance due to an irregularity in the fiber supply there are fed onto the surface 2a of the perforated drum 2 fewer fibers per unit time, then a thinner fiber layer 8 is built-up since the perforated drum 2 rotates at constant speed and carries the fiber layer 8 towards the take-off rolls 5 which remove the fiber layer from the perforated drum 2. Due to the thinner fiber deposit the pressure drop brought about by the fiber layer 8 diminishes and the pressure drop between the perforated drum 2 and the duct or channel 3 changes. This change in pressure is immediately transduced by the control device 10 into a signal which activates the drive means M for the purpose of shifting the cover shield 6 in the direction toward the take-off rolls 5, i.e., in the direction of the zone of the perforated drum 2 at which there are already deposited fibers. Owing to this movement of the slot 5 in the direction of rotation of the perforated drum 2, fibers are deposited over a longer time-span onto the same zone or region of the perforated drum 2 until there has again been reached the pre-set value w. If a disturbance occurs at a downstream or subsequently arranged machine such that the speed of the take-off rolls 5 and the perforated drum 2 is slowed down, or even ultimately brought to standstill, then the fiber feed can still continue for a certain amount of time since the surface *2a* of the perforated drum 2 in the zone of the duct 3 between the take-off rolls 5 and the duct 4, acts as a storage space or storage means. This zone between the take-off rolls 5 and the duct 4 can extend up to about three-quarters of the total surface of the perforated drum.

In this case the slot 7 of the cover shield moves towards the entry point of the duct 4 into the duct 3, in other words towards the end *3b* of the duct or channel 3. The fiber supply thus first only need be interrrupted if the surface *2a* of the perforated drum 2 is evenly covered with fibers throughout the entire zone or region of the duct 3. Conversely, an interruption in the fiber supply to the perforated drum 2 does not require immediate stoppage of the perforated drum 2, since in most cases a certain quantity of fiber layer 8 is stored as a reserve on the perforated drum 2 for the subsequent removal thereof.

By means of the apparatus of the invention at least the following advantages over conventional fiber layer-forming machines are realized:

(a) The apparatus can be used in all cases where a fiber layer of essentially constant weight per unit length is to be supplied to a machine, for instance to a card, or also to a metering device which is still more susceptible or sensitive than the one described.

(b) The apparatus can be used in all cases where the fiber layer is to be maintained essentially free of internal tensions in the direction of movement thereof.

(c) The apparatus can be used in all cases where a certain storage capacity is required in the fiber layer-forming machine for bridging short term irregularities.

While there are shown and described present preferred embodiments of the invention, it is to be distinctly understood that the invention is not limited thereto, but may be otherwise variously embodied and practiced within the scope of the following claims.

Accordingly, what I claim is:

1. A method of forming a fiber layer of essentially constant weight per unit length, comprising the steps of:

providing a moving, fiber-separating, perforated surface onto which there is supplied fibers;

providing means defining a suction opening below the perforated surface, with the suction opening extending over a predetermined region of the perforated surface;

deriving a measuring value representative of the thickness of the fiber layer of the fibers deposited onto the perforated surface; and selectively moving the suction opening forward or backward with respect to the direction of transport of the fiber layer by the perforated surface as a function of the derived measuring value.

2. The method as defined in claim 1, further including the steps of:

moving the suction opening in the direction of transport of the fiber layer by the perforated surface when the thickness of the fiber layer is too small.

3. The method as defined in claim 1, further including the steps of:

moving the suction opening in a direction opposite to the direction of transport of the fiber layer by the perforated surface when the thickness of the fiber layer is too great.

4. The method as defined in claim 1, further including the steps of:

utilizing as the measuring value the pressure drop between a point located above the perforated surface and a point located within the means providing the suction opening.

5. The method as defined in claim 1, further including the steps of:

providing as the moving, fiber-separating, perforated surface a perforated drum rotatable in a predetermined direction of rotation; and moving the suction opening in the predetermined direction of rotation of the perforated drum when the thickness of the fiber layer falls below a predetermined thickness.

6. The method as defined in claim 1, further including the steps of:

providing as the moving, fiber-separating, perforated surface a perforated drum rotatable in a predetermined direction of rotation; and moving the suction opening in a direction opposite to said predetermined direction of rotation of the perforated drum when the thickness of the fiber layer exceeds a predetermined thickness.

7. The method as defined in claim 1, further including the steps of:

providing as the moving, fiber-separating, perforated surface a perforated drum rotatable in a predetermined direction of rotation, the fibers being deposited in the form of the fiber layer onto an outer surface of said perforated drum; and deriving the measuring value by ascertaining the pressure drop between a point exterior of the surface of the drum upon which there is formed the fiber layer and a point interior of said perforated drum.

8. An apparatus for forming a fiber layer of essentially constant weight per unit length, comprising:

a rotatable perforated drum having an outer surface at which there is formed a fiber layer;

means providing a movable suction opening extending within and essentially over the full width of the perforated drum;

means for deriving a measuring value representative of the thickness of the fiber layer deposited onto the surface of the perforated drum;

drive means for selectively moving the suction opening; and control means responsive to the derived measuring value for controlling operation of said drive means.

9. The apparatus as defined in claim 8, wherein:

said rotatable perforated drum is rotatable in a predetermined direction of rotation; and said drive means moves the suction opening selectively forward or backward with respect to the direction of rotation of the perforated drum as a function of the derived measuring value.

10. The apparatus as defined in claim 9, wherein:

said suction opening possesses a width structured such that essentially the same quantity of air can penetrate through each length section of the suction opening.

11. The apparatus as defined in claim 9, wherein:

said perforated drum has an axis of rotation; and said suction opening extending essentially axially with respect to said axis of rotation.

12. The apparatus as defined in claim 9, wherein:

said suction opening extends in a substantially spiral-like configuration.

13. The apparatus as defined in claim 9, wherein:

said suction opening extends in a substantially helical-like configuration.

14. The apparatus as defined in claim 9, wherein:

said perforated drum has an impact zone for the fibers, said impact zone having a predetermined width;

said suction opening having an average width essentially corresponding to said predetermined width of the impact zone of the fibers on the perforated drum.

15. The apparatus as defined in claim 9, wherein:

said drive means for said means providing said suction opening comprises an electric motor.

16. The apparatus as defined in claim 9, wherein:

said drive means for said means providing said suction opening comprises a hydraulic motor.

17. The apparatus as defined in claim 9, wherein:

said means for supplying fibers onto the surface of the perforated drum includes a fiber guide duct arranged over at least part of the surface of the perforated drum upon which there is formed the fiber layer; and means for applying vacuum conditions to the suction opening.

18. The apparatus as defined in claim 17, wherein:

said means for deriving said measuring value is structured for measuring the pressure drop between the fiber guide duct and a region internally of the suction opening.

* * * * *